US005118557A

United States Patent [19]

Barnewall

[11] Patent Number: 5,118,557

[45] Date of Patent: Jun. 2, 1992

[54] FOAM COATING OF PRESS FABRICS TO ACHIEVE A CONTROLLED VOID VOLUME

[75] Inventor: James M. Barnewall, Albany, N.Y.

[73] Assignee: Albany International Corp., Menands, N.Y.

[21] Appl. No.: 265,258

[22] Filed: Oct. 31, 1988

[51] Int. Cl.[5] ..... B32B 5/02; D04H 1/16

[52] U.S. Cl. ..... 428/234; 139/383 A; 162/348; 162/358; 162/DIG. 1; 427/244; 427/389.9; 428/280; 428/282; 428/290; 428/300; 428/304.4; 428/306.6; 428/316.6

[58] Field of Search ..... 428/280, 290, 308.4, 428/316.6, 282, 300, 304.4, 306.6, 234; 139/383 A; 427/389.9, 244; 156/78; 162/348, 358, DIG. 1

[56] References Cited

U.S. PATENT DOCUMENTS

| | | | |
|---|---|---|---|
| 2,482,237 | 9/1949 | Berglund | 428/290 X |
| 3,617,442 | 11/1971 | Hurschman | 162/348 X |
| 4,271,222 | 6/1981 | Hahn | 428/280 X |
| 4,300,982 | 11/1981 | Romanski | 162/358 |
| 4,304,812 | 12/1981 | Perkins | 427/155 X |
| 4,588,632 | 5/1986 | Gisbourne et al. | 427/243 X |
| 4,657,806 | 4/1987 | Dutt | 428/308.4 X |
| 4,701,368 | 10/1987 | Kiuchi et al. | 428/308.4 X |
| 4,830,905 | 5/1989 | Gulya et al. | 162/DIG. 1 |
| 4,851,281 | 7/1989 | Wood | 428/280 X |

*Primary Examiner*—Michael W. Ball
*Assistant Examiner*—Michele K. Yoder
*Attorney, Agent, or Firm*—Kane, Dalsimer, Sullivan, Kurucz, Levy, Eisele & Richard

[57] ABSTRACT

This invention is directed to coating press fabrics to achieve a controlled void volume. More particularly, this invention is directed to a method of modifying a press fabric for a papermaking machine which comprises the steps of:

(a) applying a thin layer of a polymeric foam to the surface of a press fabric;
(b) drying said foam to form a coated press fabric;
(c) repeating steps (a) and (b); and
(d) curing said coated press fabric.

10 Claims, 1 Drawing Sheet

FOAM COATING OF PRESS FABRICS TO ACHIEVE A CONTROLLED VOID VOLUME

FIELD OF THE INVENTION

This invention is directed to press fabrics having a foam coating. More specifically, this invention is directed to the coating of press fabrics to achieve a controlled void volume and permeability.

BACKGROUND OF THE INVENTION

Papermakers' press fabrics are endless belts of fibrous material used for conveying a wet paper web, delivered by a wet-type papermaking machine, from a forming zone, through a pressing zone, to a drying zone. At the pressing zone there is usually provided rotating cylindrical squeeze rolls between which the freshly formed paper web is passed. As the web enters the nip of the rolls, water is squeezed from the paper and is accepted by the press fabric upon which the paper is conveyed through the nip.

Papermakers' press fabrics are well known. Such fabrics are typically formed from materials such as wool, nylon, and/or other synthetic polymeric materials and the like. With such fabrics, the paper web, after passing through the nip of the pressing rolls, usually still contains an appreciable amount of water, which adds substantially to manufacturing costs due to the high energy required to evaporate the water during the subsequent drying stage. Increasing and/or maintaining for a longer period of time the permeability and water removal capability of the press fabrics would thus be highly advantageous in that manufacturing costs would be reduced. Other objectives include smoother surface, free of needle tracks; increased sheet contact area; and uniformity of pressure distribution.

OBJECTS OF THE INVENTION

It is an object of the invention to provide an improved press fabric.

It is also an object of the invention to provide a method of treating a press fabric to achieve a predetermined permeability.

It is a further object of the invention to provide a relatively easy and predictable method of adjusting the void volume of a press fabric.

These and other objects of the invention will become more apparent in the discussion below.

DETAILED DESCRIPTION OF THE INVENTION

Figure 1:
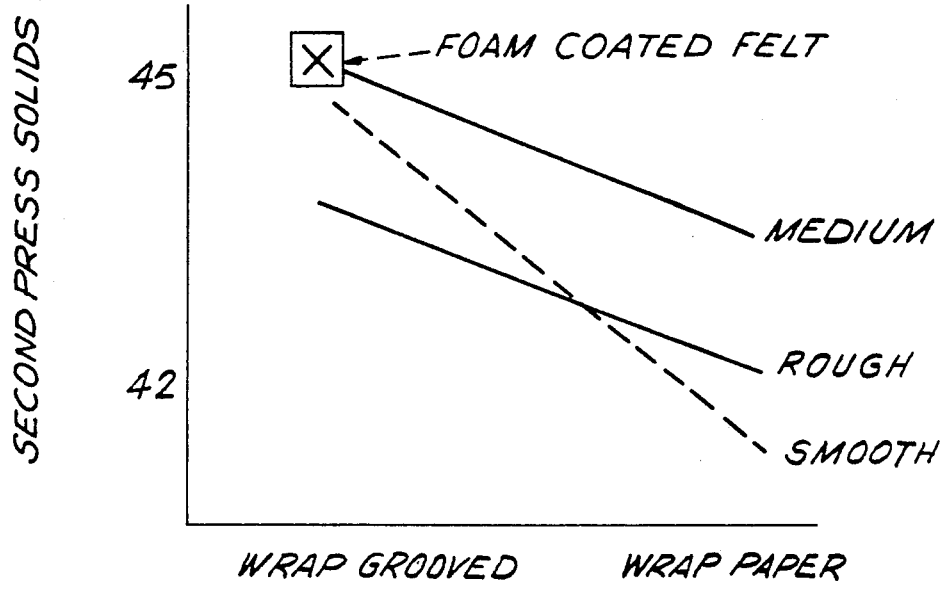
FIG. 1 represents a graph of sheet solids content versus fabric wrap caused by various press fabrics, including an embodiment of the invention.

According to the present invention, there is provided a method of modifying a papermaker's press fabric to adjust its permeability. More specifically, a papermaking press fabric is treated with one or more layers of polymeric foam that are dried and then cured.

The press fabrics to be modified include those pres fabrics known in the art. Typical such fabrics are described in, for example, U.S. Pat. Nos. 2,354,435, 2,567,097, 3,059,312, 3,158,984, 3,425,392, 3,617,442, 3,657,068, and 4,382,987, and British Patent No. 980,288, all of which are incorporated herein by reference.

It will be apparent to those skilled in the art that coating of other substrates in the manner described would result in structures having sufficient paper sheet dewatering capabilities. Examples of some of these substrates include: woven and non-woven structures, with or without needled fiber; composite structures consisting of several fibrous configurations; air-layered and wet layer fibrous sheets; and the like.

Useful resin compositions include synthetic, flexible, polymeric resin foams. Useful are foams based upon polyurethanes, polyether, polyester, polysilicone, polyacrylic, polyvinyl chloride, polyisocyanate, epoxy, polyolefins, or polyacylonitrite rubber foam, and the like. Also, a combination of two or more such elastomeric resins can be utilized. Typical of useful resin compositions are Emulsion 26172 (an acrylic emulsion representative of a large series of emulsions available from B. F. Goodrich) and Permuthane HD2004 (a water-based polyurethane emulsion available from C. L. Hauthaway).

It is recognized that the resin composition can be solvent; water-based; high solids (that is, containing little or no solvent); or a combination of solvents or cosolvents that results in complete or partial solubilization and/or suspension of the resin particles. This would also include plastisols, water-based, and other emulsions.

In addition, the foam can contain one or more surfactants, emulsifiers, stabilizers, or the like. Examples of such additives include ammonium stearate, ACRYSOL TT678 (an acrylic polymeric compound used as a thickening agent, available from Rohm & Haas), ASE 60 (an acrylic polymeric compound used as a thickening agent, available from Rohm & Haas). TAMOL (an organic salt, dispersant, used to stabilize the mixture prior to and during foaming, available from Rohm & Haas), TRITON (a nonionic detergent used herein as a foaming agent, available from Rohm & Haas). PLURONIC L62 (a non-ionic detergent, used herein as a foaming agent, available from BASF), and the like.

The foam structure in the final form, can be either an open (i.e., reticulated) or closed cell structure, or a combination thereof. In some cases collapse of the foam during curing results in a coating or bridging of the substrate fibers. Any of these forms or combinations thereof result in alteration of the substrate characteristics.

According to the invention a foam is applied to a surface, or surfaces, of a press fabric, is allowed to dry, and is, then cured. The drying and curing could be performed in separate steps or simultaneously. In some cases, it may be desirable to calender the fabric after drying and before the curing step.

The foam could be applied by any number of known procedures, which include, for example, blade coating techniques which can be on roll, off roll, or table; squeeze coating; transfer coating; spraying; kiss or applicator roll; slot applicator; and brush application. A single layer can be applied or multiple layers of the same or different foam formulations can be applied to obtain a given final result. In a preferred embodiment of the invention the foam is applied in a series of very thin layers with minimal overlap. For example, the foam could be applied in from about 2 to 10 layers, each of which is from about 1 to 10 mm thick, with an overlap of from about 1 to 80 cm, preferably from about 3 to 50 cm. Preferably the foam is applied to the press fabric as a thin continuous layer.

The resultant foam may reside entirely upon the press fabric to the extent of 90% or more extending above the surface fiber plane, or it may be partially embedded into the surface to the extent of about 50%, leaving 50% above the surface. In the alternative, the foam may be primarily embedded in the press fabric, penetrating partially or wholly into the press fabric.

Each layer is dried. After the topmost layer is dried, the coated press fabric is cured, for example, by air drying at room temperature for a sufficient length of time or at elevated temperatures for from about 1 minute to 5 hours. The temperature and time for drying or curing will be dependent upon the foam employed, manufacturing conditions, and the like.

The following examples are intended to illustrate the invention and should not be construed as limiting the invention thereto.

EXAMPLES

Examples 1

A water-based polyurethane emulsion having 40% urethane solids emulsion was prepared, and the emulsion was then foamed to a 6 to 1 below ratio. The resultant foam was used to coat a DURAVENT TM press fabric (available from Albany International Corp.) with repeated passes.

By use of a Frazer air permeability tester, the air permeability was tested. The results are set forth in the following table.

TABLE I

| Sample | No. of Coats | Thickness of Applied Layers | Air Permeability cfm/sq. ft. After Drying | Air Permeability cfm/sq. ft. After Curing |
|---|---|---|---|---|
| A* | 0 | — | (50.5) | — |
| B | 1 | 25 mils | 30 | 32 |
| C | 2 | 25 mils | 15 | 14 |
| D | 3 | 15 mils | 10 | 10 |

*Control

Note the permeability was uneffected by the curing step. It is possible to continue adding foam layers until the desired permeability is obtained.

Example 2

Foamed water-based urethanes have been considered as a replacement for 100% solids polyurethane for many reasons, for example, control of overlap when coating endless structures or when better predictability of void volume is required. As is reflected below, overlap can be controlled rather closely. Those familiar with the art will recognize that "100% solids polyurethanes" are those containing little or no solvent and are referred to as "high solids" or "100% solids" polyurethanes.

In the coating of a press fabric with foam in multiple passes, it was found that for the particular foam used, data fit the empirical equation:

$$\ln(\text{air Perm}) = \ln(\text{original Press Fabric Air Perm}) - (AP + BP^2)$$

where A and B are constants (but not the same for all materials) and P equals the number of coating passes. This formula gives an indication of the extent to which overlapping coatings changes the permeability. After several coatings the small change due to overlap would not be expected to affect sheet properties.

A coated press fabric was prepared by applying layers of a water-based polyurethane foam. The measured air permeability measured and calculated data are set forth in the following table:

TABLE II

| (cfm/sq. ft) Sample | No. of Layers | Air Permeability Observed | Air Permeability Calculated |
|---|---|---|---|
| A* | 0 | 92 | — |
| B | 1 | 77 | 76 |
| C | 4 | 38 | 38 |
| D | 6 | 24 | 22 |
| E | 8 | 10 | 11 |
| F | 10 | 4 | 5 |

*Control

EXAMPLE 3

Laboratory trials were made using polyurethane foam made from a water-based emulsion from Permuthane, said foam being applied to DURACOMB TM, 5710 Fabric, and DURAVENT TM press fabric (available from Albany International Corp.). A relatively low blow ration foam (2.7 blow ratio) was used, and several layers were applied. Air permeabilities were measured after each pass. Each fabric sample was run in duplicate, and the data from both runs are set forth below in the following table:

TABLE III

| Sample | Fabric | Uncoated | Air Permeability (cfm/sq. ft.) 1 Coat | 2 Coats | 3 Coats |
|---|---|---|---|---|---|
| A* | DURACOMB | 125 | — | — | — |
| B | DURACOMB | — | 102 | 92 | 66 |
| C | DURACOMB | — | 116 | 98 | 78 |
| D* | 5710 | 427 | — | — | — |
| E | 5710 | — | 309 | 47 | 18 |
| F | 5710 | — | 302 | 48 | 13 |
| G* | DURAVENT | 21 | — | — | — |
| H | DURAVENT | — | 20 | 16 | 10 |
| I | DURAVENT | — | 20 | 18 | 13 |

*Control

The data indicate that the reproducability is good. It is interesting to note that the open structure 5710 Fabric was closed up more with each pass than the DURACOMB fabric, indicating specific formulations for each type of fabric to be coated are necessary.

EXAMPLE 4

Two sets of fabric samples, SCREEN TEX (available from Albany International Corp.) and 5710 Fabric, were coated with a foam made from B. F. Goodrich acrylic latex. The objective was to make a series of samples with air permeabilities of approximately 40, 60, and 80 cfm/sq.ft. The results are set forth in the following table:

TABLE IV

| Sample | Fabric | No. of Layers | Air Permeability (cfm/sq. ft.) |
|---|---|---|---|
| A* | SCREEN TEX | 0 | 405 |
| B | SCREEN TEX | 2 | 87 |
| C | SCREEN TEX | 4 | 55 |
| D | SCREEN TEX | 6 | 42 |
| E* | 5710 | 0 | 478 |
| F | 5710 | 2 | 80 |
| G | 5710 | 4 | 70 |

TABLE IV-continued

| Sample | Fabric | No. of Layers | Air Permeability (cfm/sq. ft.) |
|---|---|---|---|
| H | 5710 | 6 | 40 |

*Control

Those skilled in the art of pres fabric making will recognize that the target values were closely obtained for each series.

Example 5

Trials were run on a pilot paper machine of a series of press fabrics to determine the effect on sheet dewatering and sheet printability characteristics of newsprint. Typical newsprint furnish was used. The press arrangement was three separate presses, each clothed with its own pres fabric, commonly referred to as a "Twinver Press". Four press fabrics were submitted and classified as coarse, medium, super smooth, and coated.

The coated press fabric embodied the medium fabric substructure and batt fiber, but with a urethane emulsion foam coating. The purpose was to examine whether the coating would allow coarser structure, especially coarser batt fibers, to be used in press fabrics, with no loss in properties. It was hoped that some improvements would be observed.

Figure 2:
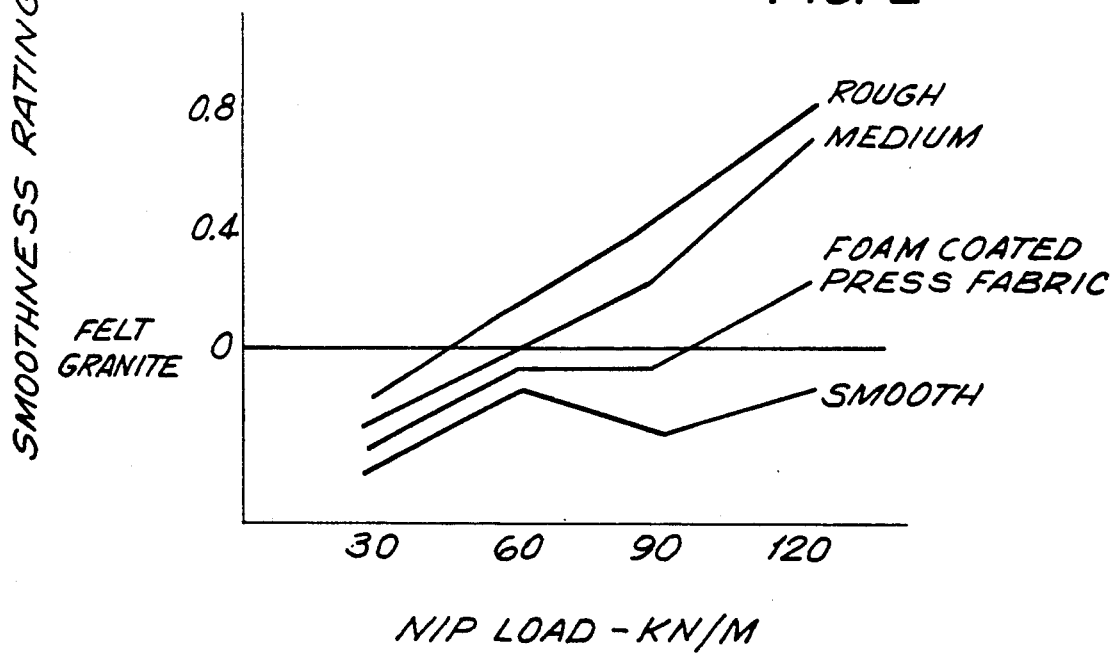
FIG. 2 represents a graphic depiction of the relationship between paper sheet smoothness and pres load for various press fabrics, including an embodiment of the invention.

The data obtained are shown in FIGS. 1 and 2. FIG. 1 represents the data taken on newsprint solids content after the last press, using slightly different fabric run take off angle geometry. This increase or decrease of contact time between press fabric and paper sheet determines the degree of "rewet" or the amount of water once mechanically removed, that is, removed from the paper sheet by the fabric, that is reabsorbed by the paper sheet at the fabric/sheet interface.

As can be seen, under the normal running conditions the medium press fabric produced the highest sheet solids con tent. The X is the condition measured for the foam coated fabric. It was not measured under all fabric run configurations. As can be seen, the solids were as high as with any press fabric tested.

As shown in FIG. 2, a ranking of "O" (zero) is that sheet surface smoothness that would be obtained by pressing the paper sheet against a smooth granite press roll. It is the objective to supply textile structures that will adhere close for this "O" (zero) ranking under operating conditions.

As can be seen in FIG. 1, no negative effects were observed on sheet dewatering. A considerable improvement in sheet smoothness for the coated fabric was noted versus the medium fabric, and the coated fabric produced nearly as smooth a sheet surface as did the supersmooth fabric, according to the data in FIG. 2.

It should be noted that the supersmooth fabric, which incorporated a very fine base fabric, and fine batt (all 3 denier fiber), would cause considerable operating problems on a production paper machine due to filling, compaction, and wearing away of the 3 denier surface fiber. Sheet following wherein the sheet does not release cleanly from the fabric after the press nip would also be expected. None of these tendencies was observed with the coated fabric during the evaluation.

Further laboratory data derived from three trials confirm that on a pressure sensitive furnish such as newsprint, smoothness increases attributable to the fabrics are a result of increased surface contact at the interface between the paper sheet and the press fabric. It therefore follows that the improved sheet smoothness values obtained were due to the increased contact area of the foamed press fabric versus a fabric with a normal textile fiber surface.

Hand sheet studies have long confirmed that porous, uniform surfaces with a high percent contact area show greater paper sheet water removal by mechanical action under conditions of pressure controlled pressing. Many studies on dewatering published in the literature confirm this. Whether the effect is due to reducing rewet in the nip or post nip or to higher sheet dewatering in the nip is still being argued by the respective schools of thought. Regardless of which mechanism prevails, the porous foamed surface pressing media disclosed herein with its higher surface contact area, its controlled porosity, and void volume will fit either theory.

The preceding specific embodiments are illustrative of the practice of the invention. It is to be understood, however, that other expedients known to those skilled in the art or disclosed herein, may be employed without departing from the spirit of the invention or the scope of the appended claims.

I claim:

1. A coated press fabric for a papermaking machine having improved water removal characteristics, imparting a better finish to the paper, and enhancing paper making characteristics, said fabric being prepared by the steps of:

(a) applying a thin continuous layer of a polymeric foam to the upper surface of a press fabric;

(b) drying said foam;

(c) repeating steps (a) and (b) one or more times sufficient to form an effective coating on said press fabric; and (d) curing the thus coated press fabric.

2. The coated fabric of claim 1, wherein the polymeric foam is primarily a polyurethane foam.

3. The coated fabric of claim 1, wherein the polymeric foam is primarily a polyacrylic foam.

4. The coated fabric of claim 1, wherein the polymeric foam comprises one or more resinous materials selected from the group consisting of polyurethanes, polyacrylates, polyethers, polyesters, polysilicones, polyvinyl chlorides, polyisocyanates, and polyacrylonitrile rubbers.

5. A coated fabric of claim 1 producing a smoother sheet surface than can be obtained with conventional textile fiber.

6. A coated fabric of claim 1 having increased sheet dewatering capability due to the increased surface contact area over that obtainable from conventional textile fiber.

7. A coated fabric of claim 1, wherein the foam resides primarily on the surface of the fabric.

8. A coated fabric of claim 1, wherein the foam resides partially on the fabric surface and partially embedded in the surface.

9. A coated fabric of claim 1, wherein the foam resides embedded below the surface of the fabric.

10. A coated fabric of claim 1, wherein the fabric material can be a woven fabric, a non-woven fabric with or without needled fibers, or a combination of several fibrous configurations.

* * * * *